US007521868B2

(12) United States Patent
Kang et al.

(10) Patent No.: US 7,521,868 B2
(45) Date of Patent: Apr. 21, 2009

(54) PLASMA DISPLAY PANEL

(75) Inventors: Kyoung-Doo Kang, Suwon-si (KR); Won-Ju Yi, Suwon-si (KR); Se-Jong Kim, Chunan-si (KR); Hun-Suk Yoo, Chunan-si (KR); Seok-Gyun Woo, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 391 days.

(21) Appl. No.: 11/395,399

(22) Filed: Mar. 30, 2006

(65) Prior Publication Data

US 2006/0223407 A1 Oct. 5, 2006

(30) Foreign Application Priority Data

Apr. 1, 2005 (KR) ..... 10-2005-0027546

(51) Int. Cl.
*H01J 17/49* (2006.01)

(52) U.S. Cl. ..... 313/586; 313/583

(58) Field of Classification Search ..... None
See application file for complete search history.

(56) References Cited

U.S. PATENT DOCUMENTS 6,166,711 A * 12/2000 Odake ..... 345/60
6,522,071 B1 * 2/2003 Park et al. ..... 313/582
2002/0003406 A1 * 1/2002 Kang et al. ..... 313/587
2003/0102804 A1 * 6/2003 Mitomo ..... 313/586
2004/0056597 A1 * 3/2004 Ko et al. ..... 313/582
2005/0116643 A1 * 6/2005 Chang et al. ..... 313/582

* cited by examiner

*Primary Examiner*—Ashok Patel
(74) *Attorney, Agent, or Firm*—Christie, Parker & Hale, LLP

(57) ABSTRACT

A plasma display panel includes a first substrate and a second substrate disposed opposite to each other and having a plurality of discharge spaces therebetween forming a display region for implementing images. Display electrodes are provided in lateral sides of the discharge spaces and extend in a first direction. Address electrodes extend in a second direction crossing the display electrodes. A dummy cell region and a frit region are provided outside of the display region. The frit region includes a first frit formed on a periphery of the first substrate, a second frit formed on a periphery of the second substrate, a dielectric layer disposed between the first substrate and the second substrate and covering the display electrodes, and electrode terminals drawn out from the display electrodes to an edge of the first substrate and the second substrate.

12 Claims, 5 Drawing Sheets

PLASMA DISPLAY PANEL

CROSS-REFERENCE TO RELATED APPLICATION

This application claims priority to and the benefit of Korean Patent Application No. 10-2005-0027546 filed in the Korean Intellectual Property Office on Apr. 1, 2005, the entire content of which is incorporated herein by reference.

BACKGROUND OF THE INVENTION (a) Field of the Invention

The present invention relates to a Plasma Display Panel (PDP). More particularly, the present invention relates to a PDP in which exhaust efficiency can be enhanced and noise of the PDP can be reduced.

(b) Description of the Related Art

A three-electrode surface-discharge type is one structure of a PDP, and will be described as an example. The PDP includes sustain electrodes, scan electrodes, and address electrodes. The sustain electrodes and the scan electrodes are disposed in parallel on the same plane of a front substrate, and the address electrodes are provided on a rear substrate, in a direction crossing the sustain electrodes and the scan electrodes. Barrier ribs are provided between the front substrate and the rear substrate, i.e., between a side of the sustain electrodes and the scan electrodes and a side of the address electrodes. Discharge cells are formed between the barrier ribs at portions where the sustain electrodes and the scan electrodes that are disposed in parallel cross the address electrodes, discharge spaces are formed in the discharge cells, and the discharge spaces are filled with a discharge gas.

The PDP selects a turn-on discharge cell through an address discharge by a scan pulse applied to the scan electrodes and an address pulse applied to the address electrodes, and implements images through a sustain discharge by a sustain pulse alternately applied to sustain electrodes and scan electrodes of the selected turn-on discharge cell. Each line of the scan electrodes and the address electrodes is controlled independently.

The sustain electrodes and the scan electrodes of the PDP are provided at the front of the discharge spaces. Hence, the PDP generates a plasma discharge between the sustain electrodes and the scan electrodes and diffuses the plasma discharge toward the rear substrate, and the plasma discharge excites phosphors within the discharge cells to generate visible rays. The sustain electrodes and the scan electrodes provided in the front substrate reduce the aperture ratio of the discharge cells and lower the transmittance of the visible rays, which are generated within the discharge cells and directed toward the front substrate. Therefore, the three-electrode surface-discharge type of PDP has low brightness and low luminous efficiency.

If the PDP is used for a long period, an electric field causes charged particles of the discharge gas to generate ion sputtering in the phosphors. The ion sputtering in the phosphors may result in permanent after-images.

As an attempt to eliminate the generation of the permanent images, a recently developed PDP is configured such that the sustain electrodes and the scan electrodes encompass the lateral sides of the discharge spaces, and the address electrodes are provided in the rear substrate. As a result, the aperture ratio of the discharge cells can be increased, and the transmittance of the visible rays can be improved.

The PDP has a frit region at an outside portion of a dummy cell provided between the front substrate and the rear substrate. A frit applied in the frit region serves to seal the front substrate and the rear substrate to each other. In other words, the front substrate is aligned on the rear substrate on the basis of the frit applied in the frit region of the rear substrate, and the front substrate and the rear substrate are then attached to each other.

In the PDP, a dielectric sheet encompassing the sustain and scan electrodes and forming discharge spaces is adhered closely to the front substrate, thereby lowering exhaust efficiency. In addition, weak adhesion between the dielectric sheet and the front substrate causes generation of a noise of the PDP.

SUMMARY OF THE INVENTION

The present invention has been made in an effort to provide a PDP in which exhaust efficiency can be enhanced and a noise of the PDP can be reduced.

An exemplary plasma display panel according to an embodiment of the present invention includes a first substrate and a second substrate disposed opposite to each other with a plurality of discharge spaces therebetween. The plurality of discharge spaces form a display region for implementing images. Display electrodes are disposed opposite to each other in a direction substantially perpendicular to the first substrate and the second substrate, are provided in lateral sides of the discharge spaces, and are formed to extend in a first direction. Address electrodes extend in a second direction crossing the display electrodes. A dummy cell region is located peripheral to the display region and a frit region is located peripheral to the dummy cell region. The frit region may include a first frit formed on a periphery of the first substrate, a second frit formed on a periphery of the second substrate, a dielectric layer disposed between the first substrate and the second substrate covering the display electrodes, and electrode terminals drawn out from the display electrodes to an edge of the first substrate and the second substrate.

The electrode terminals may be attached to the first frit.

The dielectric layer may be attached to the first frit and the second frit.

The electrode terminals may be drawn out from the dielectric layer to a space between the dielectric layer and the second substrate.

The dielectric layer includes a dielectric layer sheet.

Exhaust paths may be formed between the second substrate and the dielectric layer sheet. The exhaust paths may have a thickness corresponding to a thickness of the second frit.

The exhaust paths may be formed in the display region and the dummy cell region.

A plurality of second frits may be formed on the periphery of the second substrate and arranged to extend in the first direction with a predetermined distance between each of the plurality of second frits in the second direction.

The display electrodes include sustain electrodes encompassing one side of respective discharge spaces between the first substrate and the second substrate, and scan electrodes encompassing the other side of the respective discharge spaces, the scan electrodes being disposed apart from the sustain electrodes in the direction substantially perpendicular to the first substrate and the second substrate.

A distance between the scan electrodes and the address electrodes may be formed to be shorter than a distance between the sustain electrodes and the address electrodes.

The PDP may further include protective layers formed on an outer surface of the dielectric layer exposed to the discharge spaces.

The protective layers may be non-transparent with respect to visible rays.

DETAILED DESCRIPTION OF THE EMBODIMENTS

Figure 1:
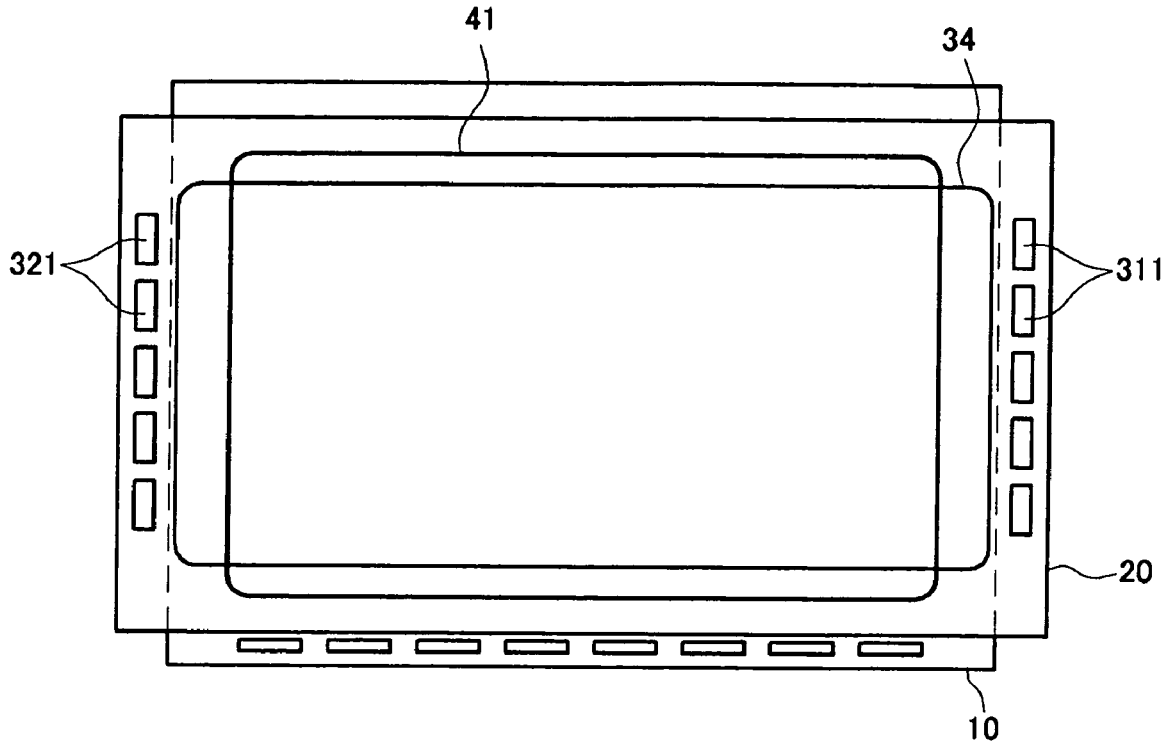
FIG. 1 is a plan view of a PDP according to a first and a second exemplary embodiment of the present invention.
Figure 2:
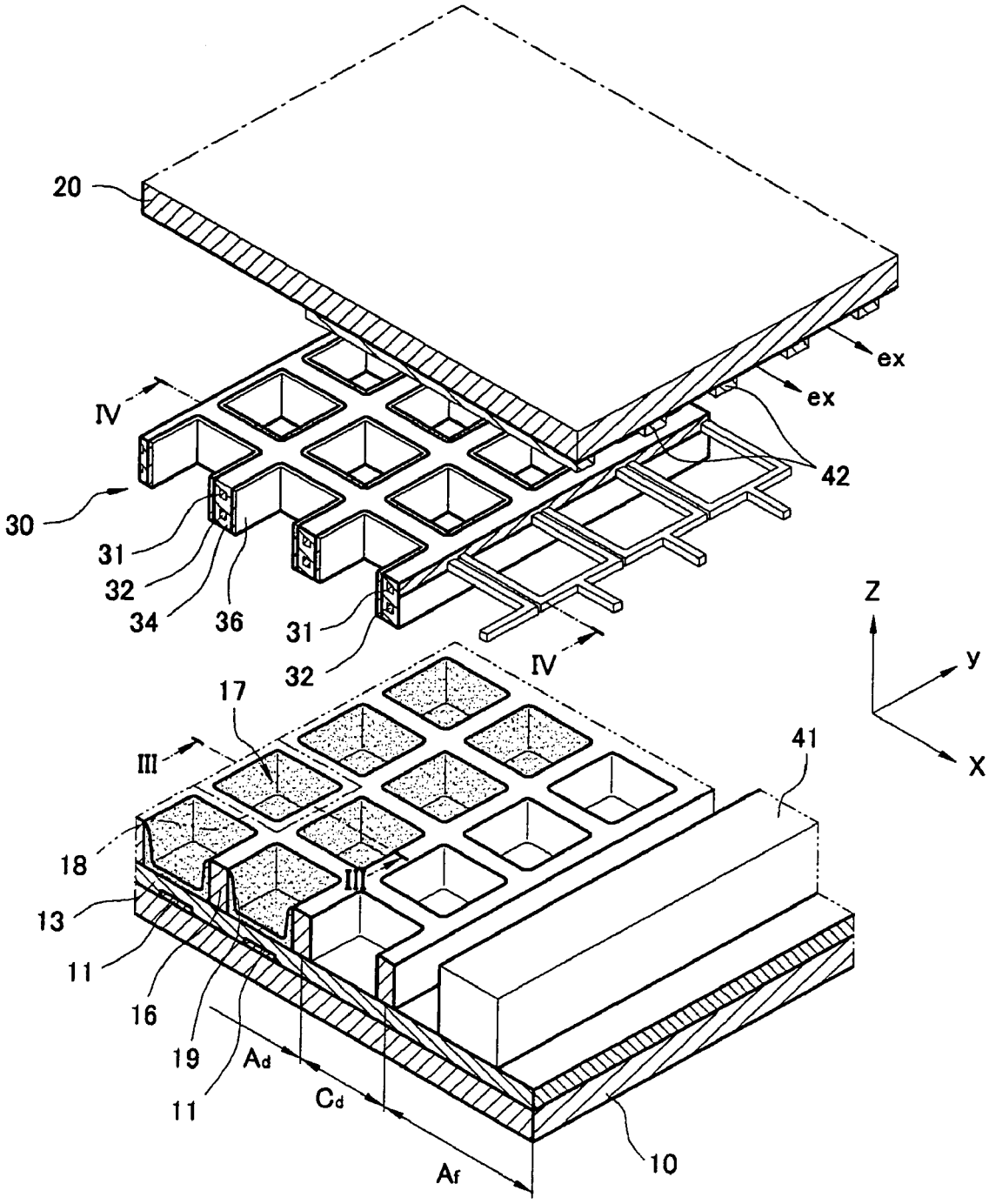
FIG. 2 is a partially exploded perspective view of a PDP according to the first exemplary embodiment of the present invention.
Figure 3:
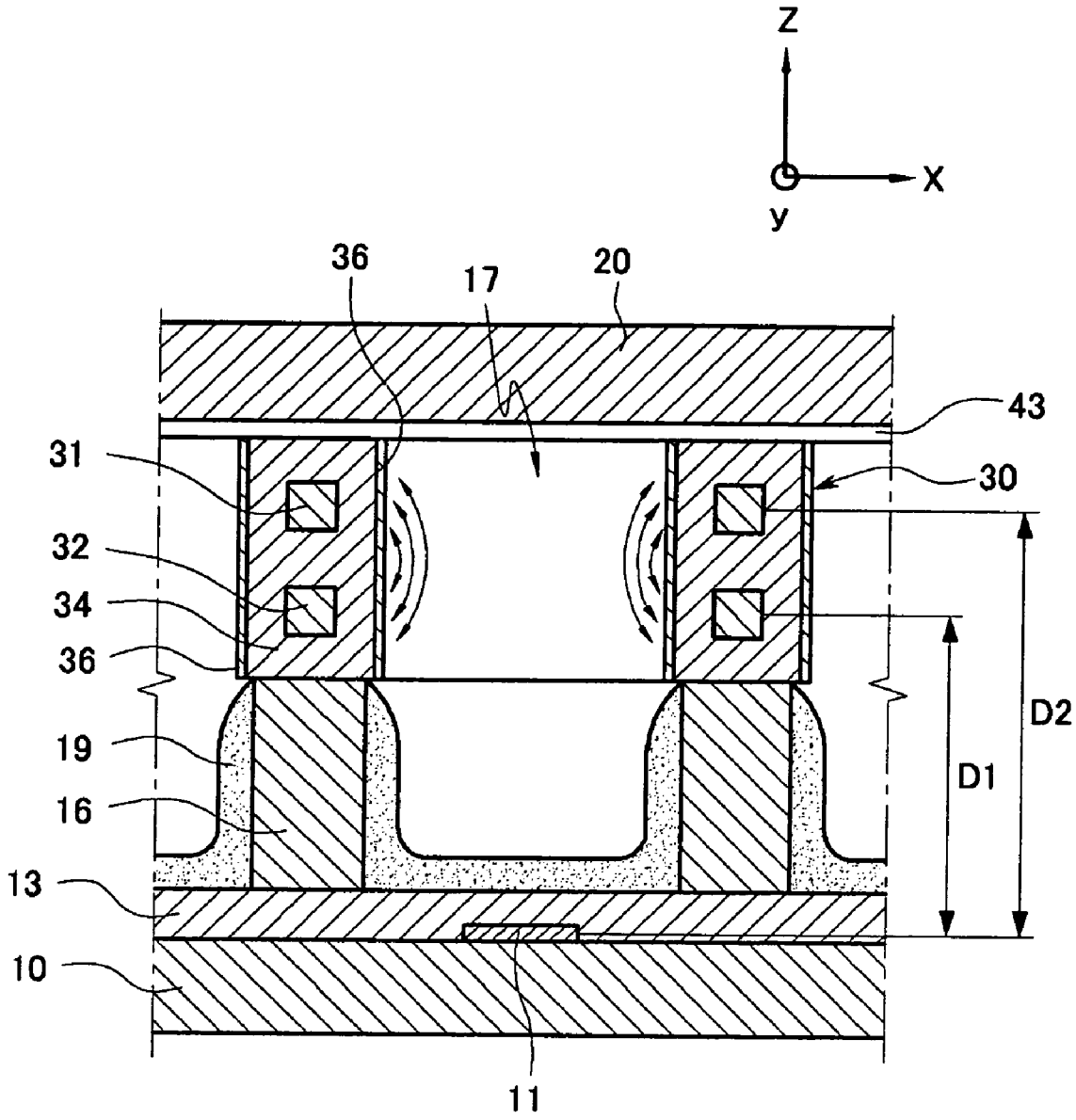
FIG. 3 is a cross-sectional view of the PDP taking along the line III-III illustrated in FIG. 2.

With reference to FIGS. 1 through 3, the PDP basically includes a first substrate 10 (hereinafter referred to as "rear substrate") and a second substrate 20 (hereinafter referred to as "front substrate"), which are disposed opposite to each other with a predetermined distance therebetween, and a barrier rib layer 16 disposed between the rear substrate 10 and the front substrate 20.

The barrier rib layer 16 partitions a plurality of discharge spaces 17 between the rear substrate 10 and the front substrate 20, and each discharge space 17 forms a discharge cell 18. The barrier rib layer 16 can be formed over the rear substrate 10 as in the present exemplary embodiment, or it can be formed over the front substrate 20, although this is not illustrated. Also not illustrated, the barrier rib layer 16 can be separated from or integrally formed over both of the rear substrate 10 and the front substrate 20.

The barrier rib layer 16 can form the discharge space 17 in various planar shapes (with reference to an x-y plane). For example, the planar shape of the discharge space 17 may be a polygonal shape such as rectangular, hexagonal, and octagon shape, a circular shape, or an elliptical shape. The discharge spaces 17 exemplified in the first exemplary embodiment are formed in a rectangular shape.

The discharge spaces 17 include phosphor layers 19 for absorbing vacuum ultraviolet (VUV) rays and emitting visible rays, and are filled with a discharge gas, for instance a mixed gas containing neon (Ne) and xenon (Xe), to generate VUV rays by a plasma discharge.

The phosphor layers 19 can be formed over the inner surfaces of the discharge spaces 17 configured by the barrier rib layer 16 and over one or both surfaces of the front substrate 20 and the rear substrate 10, which form the discharge spaces 17. As illustrated, when the phosphor layers 19 are formed over the rear substrate 10, the phosphor layers 19 are formed as a reflective type in which the phosphor layers 19 absorb VUV rays at the inner side of the discharge spaces 17 and reflect visible rays toward the front substrate 20.

In addition, although not illustrated, when the phosphor layers 19 are formed over the front substrate 20, the phosphor layers 19 are formed as a transmissive type in which the phosphor layers 19 absorb VUV rays at the inner side of the discharge spaces 17 and transmit visible rays. The phosphor layers 19 can also be formed over both of the front substrate 20 and the rear substrate 10.

According to the first exemplary embodiment of the present invention, the PDP includes address electrodes 11 and display electrodes that are disposed between the rear substrate 10 and the front substrate 20 in order to implement images through generation of VUV rays that are to collide with the phosphor layers 19 as a plasma discharge. The display electrodes include sustain electrodes 31 and scan electrodes 32 that are disposed opposite to each other in a direction vertical to the front and rear substrates 20 and 10 and are provided in lateral sides of the discharge spaces 17. The sustain electrodes 31 and the scan electrodes 32 are formed to extend in a first direction (e.g., the x-axis direction). Specifically, the address electrodes 11 correspond to the respective discharge spaces 17. The sustain electrodes 31 encompass one side of the respective discharge spaces 17 in a direction vertical to the planes of the rear substrate 10 and the front substrate 20 at the discharge spaces 17 (e.g., the z-axis direction), and are connected in the first direction. The scan electrodes 32 encompass the other side of the respective discharge spaces 17 while the scan electrodes 32 are disposed apart from the sustain electrodes 31 and the address electrodes 11 in the vertical direction (i.e., the z-axis direction), and are connected in the first direction (i.e., the x-axis direction).

Although not illustrated, the address electrodes 11 can be formed in a separate electrode layer in addition to the sustain electrodes 31 and the scan electrodes 32, and they can be disposed between the rear substrate 10 and the front substrate 20. As illustrated, the sustain electrodes 31 and the scan electrodes 32 can be formed in a separate electrode layer 30 and be disposed between the rear substrate 10 and the front substrate 20. In this case, the address electrodes 11 can be formed over the rear substrate 10. Although not illustrated, the address electrodes 11 can be formed on the front substrate 20.

In the present exemplary embodiment, the address electrodes 11 are formed over the rear substrate 10, and the barrier rib layer 16 is formed over the rear substrate 10. The sustain electrodes 31 and the scan electrodes 32 are formed in the separate electrode layer 30, which is disposed between the front substrate 20 and the barrier rib layer 16. Although not illustrated, the sustain electrodes 31 and the scan electrodes 32 can be formed directly inside the barrier rib layer 16. In this case, the electrode layer 30 serves an additional role as the barrier rib layer 16, which defines the discharge spaces 17.

As illustrated in the present exemplary embodiment, each of the address electrodes 11 is formed to extend on an inner surface of the rear substrate 10 along a second direction (e.g., the y-axis direction), and thus the address electrodes 11 consecutively correspond to the discharge spaces 17 adjacent to the second direction. A plurality of the address electrodes 11 are arranged in parallel with a certain distance therebetween by respectively corresponding to the discharge spaces 17 adjacent to the first direction (i.e., the x-axis direction) crossing the second direction (i.e., the y-axis direction).

The address electrodes 11 are formed over the inner surface of the rear substrate 10, and can be covered with a dielectric layer 13. The dielectric layer 13 reduces direct collisions of positive ions or electrons to the address electrodes 11 during the discharge, so that damage to the address electrodes 11 can be reduced. The dielectric layer 13 includes a dielectric material so that wall charges can be accumulated thereon. In the case when the dielectric layer 13 is provided, the phosphor layers 19 are formed over the inner surfaces of the discharge spaces 17 and over the surface of the dielectric layer 13 disposed inside the discharge spaces 17.

As illustrated, when the address electrodes 11 are formed over the rear substrate 10 that does not transmit visible rays, the address electrodes 11 can include a metallic material with good electrical conductivity.

The address electrodes 11 are extended in a direction crossing the scan electrodes 32 and the sustain electrodes 31 for the purpose of addressing one discharge space 17 by an address pulse applied to the address electrodes 11 and a scan pulse applied to the scan electrodes 32. In addition, the address electrodes 11 are disposed apart from the sustain electrodes 31 and the scan electrodes 32 in the vertical direction (i.e., the z-axis direction) with respect to the rear substrate 10 and the front substrate 20.

The sustain electrodes 31 and the scan electrodes 32 implement images by generating a sustain discharge using a sustain pulse alternately applied at the selected discharge space 17 through the address discharge. For the sustain discharge, the sustain electrodes 31 and the scan electrodes 32 are disposed apart from each other within the electrode layer 30 in the vertical direction (i.e., the z-axis direction) with respect to the rear substrate 10 and the front substrate 20. The sustain electrodes 31 and the scan electrodes 32 can be formed to have a symmetrical structure.

Since the address electrodes 11, the sustain electrodes 31, and the scan electrodes 32 can serve different roles according to signal voltages applied thereto, a relationship between electrodes 11, 31, 32 and voltage signals is not limited to only a relationship in which the voltage signals are applied to electrodes 11, 31, 32.

In the present exemplary embodiment, the address electrodes 11 are provided in the rear substrate 10, and the barrier rib layer 16 is disposed over the address electrodes 11. The sustain electrodes 31 and the scan electrodes 32 are formed in the electrode layer 30, which is disposed between the barrier rib layer 16 and the front substrate 20. Within the electrode layer 30, the sustain electrodes 31 are provided to the front substrate 20 side, whereas the scan electrodes 32 are provided to the barrier rib layer 16 side. In other words, a distance D1 between the scan electrodes 32 and the address electrodes 11 is formed to be shorter than a distance D2 between the sustain electrodes 31 and the address electrodes 11. As a result, a short discharge gap exists between the scan electrodes 32 and the address electrodes 11, and thus an address discharge can be generated using a low voltage level.

The sustain electrodes 31 are formed between the rear substrate 10 and the front substrate 20 to encompass one side of the respective discharge spaces 17 in the vertical direction (i.e., the z-axis direction) with respect to the rear substrate 10 and the front substrate 20.

The scan electrodes 32 are disposed apart from the sustain electrodes 31, and are formed between the rear substrate 10 and the front substrate 20 to encompass the other side of the respective discharge spaces 17 in the vertical direction (i.e., the z-axis direction) with respect to the rear substrate 10 and the front substrate 20.

As illustrated in FIG. 3, the sustain electrodes 31 and the scan electrodes 32 are formed to have a symmetrical structure in the vertical direction (i.e., the z-axis direction) with respect to the rear substrate 10 and the front substrate 20. Therefore, a sustain discharge generated between the sustain electrodes 31 and the scan electrodes 32 is directed in the vertical direction (i.e., the z-axis direction) within the discharge spaces 17. This particular direction of the sustain discharge causes an electric field generated by a voltage applied to the sustain electrodes 31 and the scan electrodes 32 to be concentrated at the center of the discharge spaces 17. As a result, luminous efficiency can be improved, and ions generated in the case of a prolonged discharge are not collided with the phosphor layers 19 due to the electric field. Therefore, damage to the phosphor layers 19 caused by ion sputtering can be reduced.

Since the sustain electrodes 31 and the scan electrodes 32 are formed to encompass the discharge spaces 17, the sustain discharge generated in the vertical direction within the discharge spaces 17 can be uniformly formed throughout the entire inner surface of the discharge spaces 17.

The sustain electrodes 31 and the scan electrodes 32 are provided at the lateral sides of the discharge spaces 17 along with the separate electrode layer 30. For this reason, the sustain electrodes 31 and the scan electrodes 32 do not block visible rays. The sustain electrodes 31 and the scan electrodes 32 can therefore include a metallic material with good electrical conductivity.

The sustain electrodes 31 and the scan electrodes 32 are covered with a dielectric layer, thereby forming a mutual insulation structure. In the present exemplary embodiment, the dielectric layer includes a dielectric layer sheet 34. The sustain electrodes 31, the scan electrodes 32, and the dielectric layer sheet 34 that covers the sustain electrodes 31 and the scan electrodes 32 construct the electrode layer 30. The dielectric layer sheet 34 accumulates wall charges during the discharge as well as forms insulation structures of the respective electrodes (i.e., the sustain electrodes 31 and the scan electrodes 32). The dielectric layer sheet 34 formed over outer surfaces of the sustain electrodes 31 and the scan electrodes 32 can form the discharge spaces 17 in a rectangular shape corresponding to the structure of the barrier rib layer 16. The sustain electrodes 31, the scan electrodes 32, and the dielectric layer sheet 34 can be manufactured by a Thick Film Ceramic Sheet method (TFCS method).

Since the dielectric layer sheet 34 and the barrier rib layer 16 form the discharge spaces 17, the dielectric layer sheet 34 can be covered with protective layers 36 over the inner surfaces of the discharge spaces 17. Particularly, the protective layers 36 can be formed at portions exposed to a plasma discharge arising at the discharge spaces 17. Although the protective layers 36 protect the dielectric layer sheet 34 and require a high secondary electron emission coefficient, the protective layer 36 does not need to have a transparent characteristic with respect to visible rays. In other words, since the sustain electrodes 31 and the scan electrodes 32 are not formed over the front substrate 20 and over the rear substrate 10 but rather are formed between the front substrate 20 and the rear substrate 10, the protective layers 36 formed over the dielectric layer 34, which covers the sustain electrodes 31 and the scan electrodes 32, can include a material exhibiting a non-transparent characteristic with respect to the visible rays. As an example of the protective layer 36, magnesium oxide (MgO) that is non-transparent with respect to visible rays has a higher secondary electron emission coefficient than MgO that is transparent with respect to the visible rays. Thus, the non-transparent MgO can decrease a discharge firing voltage level to a greater extent.

Figure 4:
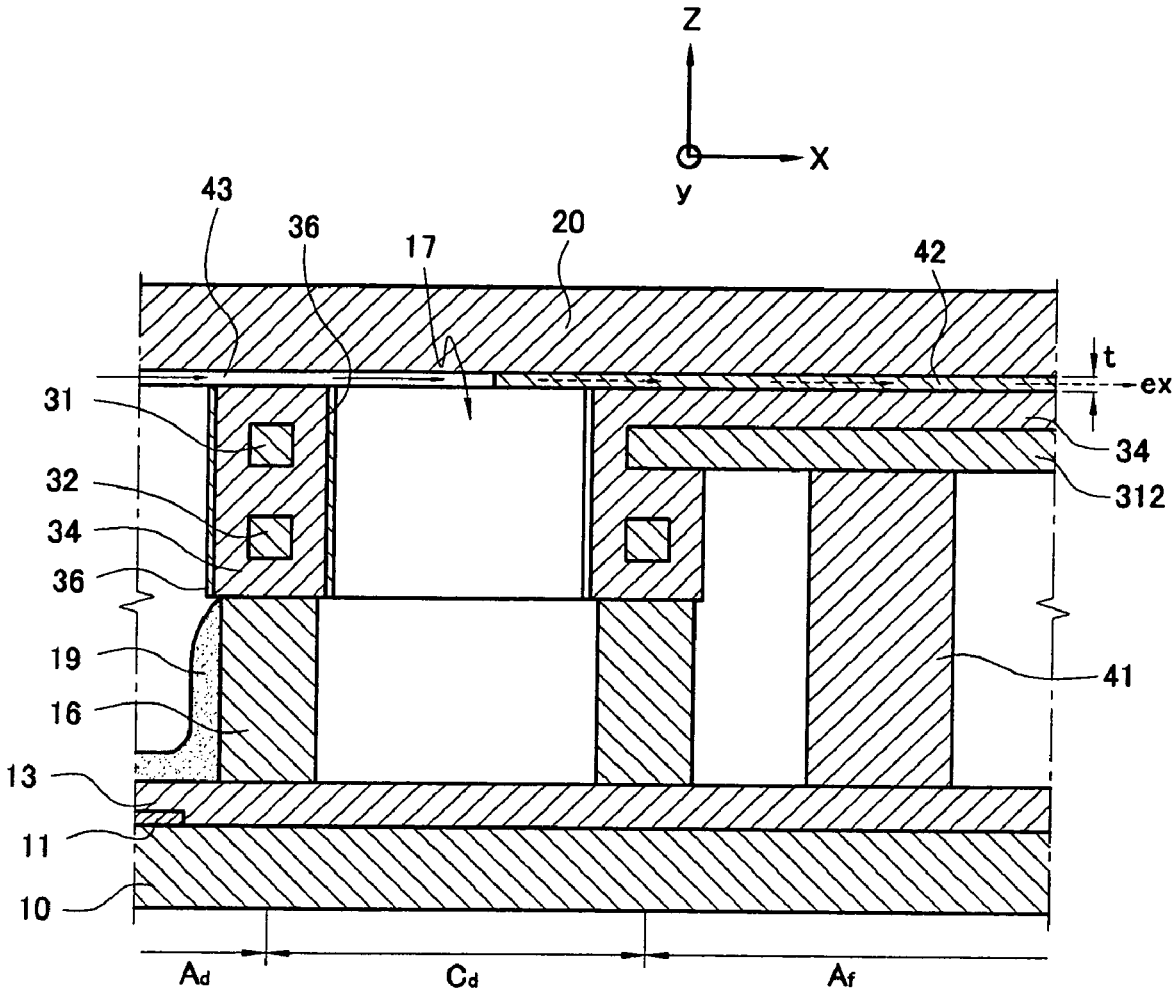
FIG. 4 is a cross-sectional view of the PDP taking along the line IV-IV illustrated in FIG. 2.

FIG. 4 is a partial cross-sectional view of the PDP taking along the line IV-IV illustrated in FIG. 2. The PDP according to the first exemplary embodiment includes a display region Ad, a dummy cell region Cd, and a frit region Af.

Since the display region Ad is configured as mentioned above, an address discharge and a sustain discharge can be generated.

The dummy cell region Cd is formed outside of the display region Ad. Since the phosphor layers 19 are not formed in the dummy cell region Cd, visible rays are not generated in the dummy cell region Cd.

The frit region Af is a region in which the rear substrate 10 and the front substrate 20 are attached to each other. The frit region Af includes a first frit 41, a second frit 42, a dielectric layer sheet 34, and electrode terminals 312. The first frit 41 is formed on the periphery of the rear substrate 10, and the second frit 42 is formed on the periphery of the front substrate 20. The dielectric layer sheet 34 covering the display electrodes is disposed between the first frit 41 and the second frit 42. The electrode terminals 312 are drawn out to an edge of the rear and front substrates 10 and 20. The electrode terminals 312 are connected to electrode terminal portions 311 in FIG. 1, and thus a sustain pulse is applied to the sustain electrodes 31.

Although not illustrated, like the sustain electrodes 31 side, the first frit 41, the second frit 42, the dielectric layer sheet 34, and electrode terminals of the scan electrodes 32 are provided opposite to the electrode terminals 312. The electrode terminals of the scan electrodes 32 are connected to electrode terminal portions 321 that are disposed opposite to the electrode terminals 312 of the sustain electrodes 31. Therefore, a sustain pulse or scan pulse can be applied to the scan electrodes 32.

As illustrated in FIGS. 1, 2 and 4, the first frit 41 is formed on the periphery of the rear substrate 10 and attached thereto. The electrode terminals 312 are drawn out to the frit region Af, and attached to the first frit 41. Although not illustrated, like the sustain electrodes 31 side, the electrode terminals of the scan electrodes 32 are drawn out opposite to the electrode terminals 312 of the sustain electrodes 31, and are attached to the first frit 41.

The second frit 42 is formed on the periphery of the front substrate 10 in the frit region Af, and attached thereto. The second frit 42 is interposed between the dielectric layer sheet and the front substrate 20 with a predetermined thickness t.

Therefore, when the front substrate 20 and the rear substrate 10 are aligned and attached to each other, the dielectric layer sheet 34 and the electrode terminals 312 are interposed therebetween.

Since the first frit 41 is provided on the rear substrate 10 and the second frit 42 is provided on the front substrate 20, the electrode terminals 312 and the dielectric layer sheet 34 can be attached to the front substrate 20. Thus, the attachment strength between the front substrate 20 and the rear substrate 10 can be improved. In addition, vibration of the front substrate 20 and the rear substrate 10 can be reduced, and the noise of the PDP can be lowered.

Exhaust paths 43 are formed between the front substrate 20 and the dielectric layer sheet 34. Specifically, the exhaust paths 43 are formed in the display region Ad and the dummy cell region Cd, and have a thickness corresponding to a thickness of the second frit 42 measured in the z-axis direction. For the purpose of forming the exhaust paths 43 easily, the second frit 42 is formed to extend in the direction (e.g., x-axis direction) crossing the address electrodes 11. Furthermore, a plurality of second frits 42 are arranged with a predetermined interval therebetween in a lengthwise direction (e.g., y-axis direction).

Thus, the exhaust paths defined by the second frit 42 have a thickness corresponding to the thickness t of the second frit 42. Since the exhaust paths 43 are defined by the second frit 42, efficiency of exhaust (ex in FIG. 4) can be improved when the residual air in the discharge spaces 17 is exhausted.

Figure 5:
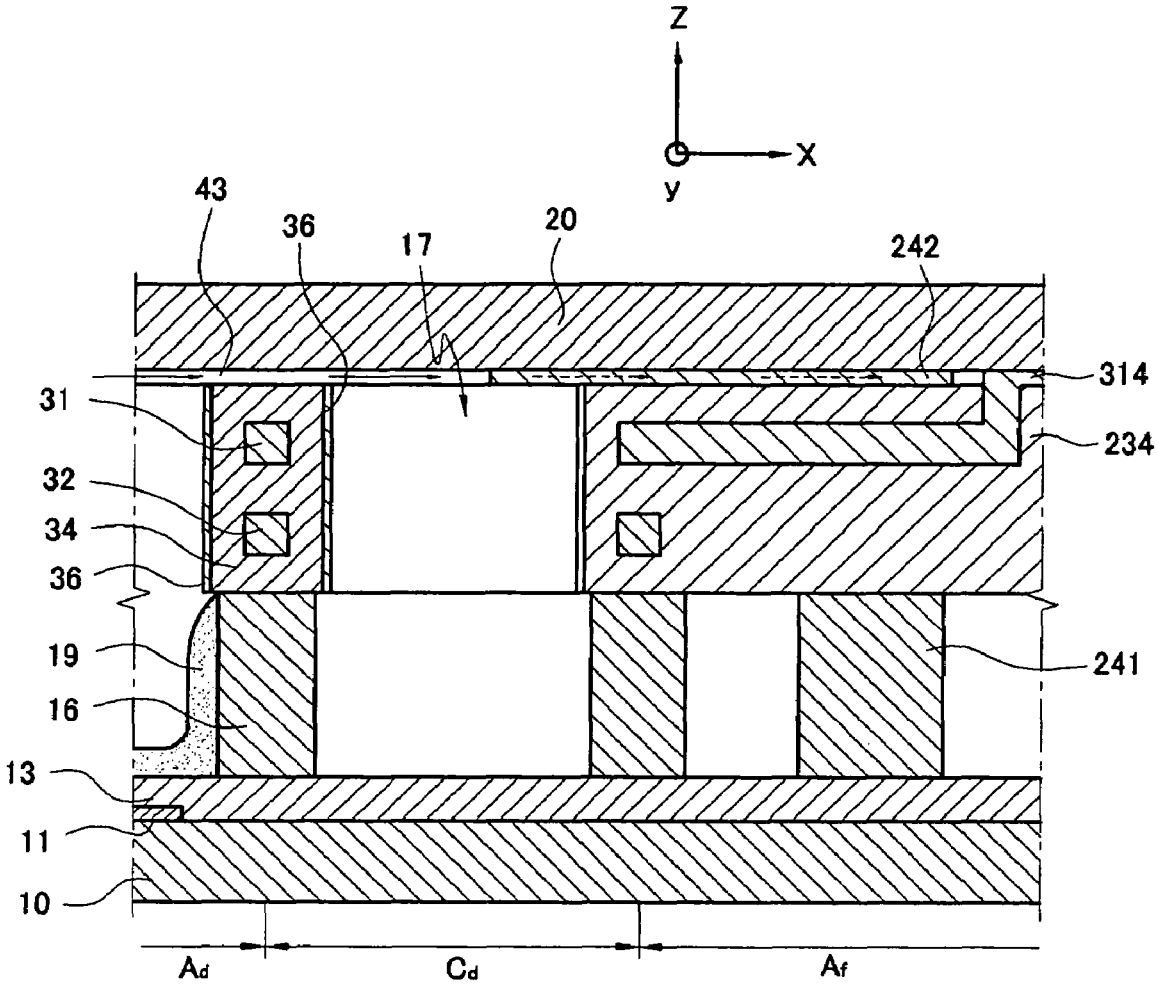
FIG. 5 is a partial cross-sectional view of a PDP according to the second exemplary embodiment of the present invention.

FIG. 5 is a partial cross-sectional view of a PDP according to the second exemplary embodiment of the present invention. Unlike in the first exemplary embodiment, the first frit 241 is configured to not attach directly to the electrode terminals 314. In other words, the electrode terminals 314 are drawn out from the dielectric layer sheet 234 to a space between the front substrate 20 and the dielectric layer sheet 234. Thus, the dielectric layer sheet 234 is attached directly to the first frit 241 and the second frit 242, and the electrode terminals 314 are not attached to the first frit 241. By this configuration, the dielectric layer sheet 234 is attached to the front substrate 20 and the rear substrate 10, and thus the attachment strength can be improved and the noise of the PDP can be reduced.

As described above, the PDP according to the exemplary embodiments of the present invention includes the display region, the dummy cell region, and the frit region. In addition, the frit region includes the first frit formed on the rear substrate, the second frit formed on the front substrate, the electrode terminals drawn out from the display electrodes, and the dielectric layer sheet. The dielectric layer sheet and the electrode terminals attach to the first frit, and the dielectric layer sheet and the front substrate attach to the second frit. Thus, the display region and the dummy cell region in which the second frit is not formed have exhaust paths between the dielectric layer sheet and the front substrate, thereby improving efficiency of exhaust. In addition, since the second frit can reinforce the attachment strength between the dielectric layer sheet and the front substrate, the noise of the PDP can be reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel comprising:

a first substrate and a second substrate opposite to each other with a plurality of discharge spaces between the first substrate and the second substrate, the plurality of discharge spaces forming a display region for implementing images;

display electrodes opposite to each other in a direction substantially perpendicular to the first substrate and the second substrate, in lateral sides of the discharge spaces, and extending in a first direction;

address electrodes extending in a second direction crossing the display electrodes;

a dummy cell region peripheral to the display region; and a frit region peripheral to the dummy cell region, the frit region including:

a first frit on a periphery of the first substrate, a second frit on a periphery of the second substrate, a dielectric layer between the first substrate and the second substrate covering the display electrodes, and electrode terminals extending from the display electrodes to an edge of the first substrate and the second substrate.

2. The plasma display panel of claim 1, wherein the electrode terminals are attached to the first frit.

3. The plasma display panel of claim 1, wherein the dielectric layer is attached to the first frit and the second frit.

4. The plasma display panel of claim 3, wherein the electrode terminals are extend from the dielectric layer to a space between the dielectric layer and the second substrate.

5. The plasma display panel of claim 1, wherein the dielectric layer comprises a dielectric layer sheet.

6. The plasma display panel of claim 5, wherein exhaust paths are between the second substrate and the dielectric layer sheet, the exhaust paths having a thickness corresponding to a thickness of the second frit.

7. The plasma display panel of claim 6, wherein the exhaust paths are in the display region and in the dummy cell region.

8. The plasma display panel of claim 1, further comprising additional second frits on the periphery of the second substrate and extending in the first direction with a distance in the second direction between a first one of the additional second frits and the second frit.

9. The plasma display panel of claim 1, wherein the display electrodes comprise sustain electrodes encompassing one side of respective discharge spaces between the first substrate and the second substrate, and scan electrodes encompassing an other side of the respective discharge spaces, the scan electrodes being apart from the sustain electrodes in the direction substantially perpendicular to the first substrate and the second substrate.

10. The plasma display panel of claim 9, wherein a distance between the scan electrodes and the address electrodes is shorter than a distance between the sustain electrodes and the address electrodes.

11. The plasma display panel of claim 1, further comprising protective layers on an outer surface of the dielectric layer exposed to the discharge spaces.

12. The plasma display panel of claim 11, wherein the protective layers are non-transparent with respect to visible rays.

* * * * *